United States Patent [19]

de Vries

[11] 4,159,957

[45] Jul. 3, 1979

[54] MANNICH BASE DISPERSANT COMBINATION

[75] Inventor: Louis de Vries, Greenbrae, Calif.

[73] Assignee: Chevron Research Company, San Francisco, Calif.

[21] Appl. No.: 920,873

[22] Filed: Jun. 30, 1978

[51] Int. Cl.[2] ..... C10M 1/32; C10M 3/26; C10M 5/20; C10M 7/30

[52] U.S. Cl. ..... 252/33.4; 252/49.6; 252/51.5 R

[58] Field of Search ..... 252/33.4, 49.6, 51.5 R

[56] References Cited

U.S. PATENT DOCUMENTS

| | | | |
|---|---|---|---|
| 2,931,773 | 4/1960 | Thompson et al. | 252/33.4 |
| 3,539,633 | 11/1970 | Piasek et al. | 252/33.4 |
| 3,897,350 | 7/1975 | Heiba et al. | 252/33.4 |

*Primary Examiner*—Delbert E. Gantz
*Assistant Examiner*—Irving Vaughn
*Attorney, Agent, or Firm*—D. A. Newell; L. L. Vaughan

[57] ABSTRACT

A lubricating oil of outstanding detergency contains an alkaline earth metal aliphatic sulfonate and a Mannich base condensation product.

8 Claims, No Drawings

MANNICH BASE DISPERSANT COMBINATION

FIELD OF THE INVENTION

This invention relates to additives for lubricating oils. More specifically, it relates to the combination of a sulfonate and a Mannich base in a lubricating oil.

BACKGROUND OF THE INVENTION

The use of Mannich bases as dispersants or detergents in lubricating oils is well known. These additives are often used in combination with conventional aromatic, usually petroleum-derived, sulfonates.

SUMMARY OF THE INVENTION

It has now been found that the combination of a high-molecular-weight Mannich base with an alkaline earth metal substantially saturated aliphatic sulfonate yields a lubricating oil additive of superior detergency as compared to the combination of high-molecular-weight Mannich base with conventional aromatic sulfonate.

DETAILED DESCRIPTION OF THE INVENTION

The sulfonates used in this invention are alkaline earth metal substantially saturated aliphatic sulfonates, which can be described by the formula $(R—SO_3)_2M$, where R is a substantially saturated aliphatic substituent containing from about 50 to 300 and preferably from about 50 to 100 carbon atoms. "Substantially saturated" means that at least about 95% of the carbon-to-carbon covalent linkages are saturated. Too many sites of unsaturation make the molecule more easily oxidized, degraded and polymerized. This makes the products unsuitable for many uses in hydrocarbon oils.

The substantially saturated aliphatic substituent may contain polar substituents. However, there should not be enough substituents to change the hydrocarbon character of the radical. Such polar substituents are exemplified by chloro, keto, alkoxy, etc. The presence of such polar groups is not preferred. The polar substituents on the radical should not be more than approximately 10% based on the weight of the hydrocarbon portion of the radical.

The sources of the substantially saturated aliphatic substituent include principally substantially saturated polyolefins, particularly polymers of monoolefins having from about 2 to 30 carbon atoms. The especially useful polymers are the polymers of 1-monoolefins such as ethylene, propene, 1-butene, isobutene, 1-hexene, 1-octene, 2-methyl-1-heptene, 3-cyclohexyl-1-butene and 2-methyl-5-propyl-1-hexene. Polymers of olefins in which the olefinic linkage is not at the terminal position, such as 2-butene, 3-pentene and 4-octene, are also useful.

Interpolymers of olefins, such as those illustrated above, with other interpolymerizable olefinic substances such as 1-olefins, cyclic olefins and polyolefins, can also be used. These include those prepared by polymerizing isobutene with butadiene, propene with isoprene, ethylene with piperylene, isobutene with chloroprene, 1-hexene with 1,3-hexadiene, 1-octene with 1-hexene, 1-heptene with 1-pentene, 3-methyl-1-butene with 1-octene, 3,3-dimethyl-1-pentene with 1-hexene, etc.

The relative proportions of the monoolefins to the other monomers in the interpolymers influence the stability and oil solubility of the final compositions. To have oil solubility and stability the interpolymers should be substantially saturated, i.e., they should contain no more than about 5% of the olefinic linkages, based on the total number of carbon-to-carbon covalent bonds. Usually, each molecule would have about one olefinic linkage. The percentage of olefinic linkages should be less than about 2% of the total number of carbon-to-carbon covalent linkages.

Specific examples of such interpolymers include terpolymer of 98% isobutene and 1% piperylene and 1% chloroprene, terpolymer polymer of 95% isobutene with 2% 1-butene and 3% 1-hexene, terpolymer of 60% isobutene with 20% 1-pentene and 20% 1-octene, copolymer of 80% 1-hexene and 20% 1-heptene, terpolymer of 90% isobutene with 2% cyclohexene and 8% propene, and copolymer of 80% ethylene and 20% propene.

Preferred starting materials for the aliphatic groups are polybutene, polyisobutene and polypropylene. Particularly preferred is polyisobutylene.

The metal component M of the sulfonate can be any Group II metal which forms a salt with the sulfonic acid moiety and which yields a salt which can function as a detergent in lubricating oil compositions. The Group II metals include magnesium, calcium, strontium, barium and zinc. Preferably, the metal M is calcium or magnesium.

The hydrocarbon from the sources mentioned above can be converted into the corresponding sulfonic acid or salt thereof by many procedures, two of which are described below. In one procedure, the hydrocarbon is reacted with a conventional sulfonating agent such as sulfur trioxide, chlorosulfonic acid, etc. Chlorosulfonic acid is preferred. These methods are well known in the art.

In an alternative preparation of the hydrocarbylsulfonic acid, the hydrocarbon is first reacted with an alkyl bromo- or chlorosulfonate, optionally in the presence of a solvent such as 1,2-dichloroethane, ether, and the like. The reaction proceeds satisfactorily at temperatures from 20°-120° C., preferably from 70°-90° C., but below the decomposition point of the reactants and products. The reaction may be carried out at subatmospheric, atmospheric or superatmospheric pressures; however, for the sake of convenience, the reaction is ordinarily conducted at atmospheric pressure.

The hydrocarbon and alkyl chlorosulfonate are ordinarily reacted using a slight molar excess of the sulfonate, based on the hydrocarbon. Preferably from 1.1 to 2 mols of alkyl chlorosulfonate per mol of hydrocarbon is employed.

The alkyl portion of the alkyl chlorosulfonate contains from 1 to 4 carbon atoms. Ethyl chlorosulfonate is preferred because it is easily prepared and reacts readily with olefinic hydrocarbon.

The alkaline earth metal salts can be prepared by any suitable means. One method comprises combining a basically reacting metal compound, such as the oxide or hydroxide, with the acid or alkyl ester of the hydrocarbyl sulfonic acid prepared as described above. This is generally carried out in the presence of a hydroxylic promoter such as water, methanol or ethylene glycol, and an inert solvent for the sulfonate, typically with heating. Under these conditions, the basically reacting compound will yield the metal sulfonate. The hydroxylic promoter and solvent can then be removed to yield the metal sulfonate.

Under certain circumstances, it may be more convenient to prepare Group I metal salts of the sulfonate and convert this material by metathesis into the alkaline earth metal sulfonate. Using this method, the sulfonic acid or alkyl sulfonate prepared above is combined with a basic Group I metal compound such as sodium or potassium hydroxide. The sodium or potassium sulfonate obtained can be purified by aqueous extraction. Then, the Group I metal sulfonate is combined with the alkaline earth metal salt to form the alkaline earth metal sulfonate. The most commonly used alkaline earth metal salt is a halide, particularly a chloride. Typically the sodium or potassium sulfonate is combined with an aqueous alkaline earth metal chloride solution and stirred for a sufficient time to allow metathesis to occur. Thereafter the water phase is removed and the solvent may be evaporated, if desired.

If a sulfonate having a completely saturated hydrocarbyl group is desired, it must be hydrogenated using hydrogen, and a conventional noble metal or noble metal oxide hydrogenation catalyst, such as platinum or platinum oxide.

The preferred sulfonates are the calcium and magnesium sulfonates.

The high-molecular-weight Mannich bases for use in this invention are conventional materials whose preparation is described in U.S. Pat. No. 3,539,633, the disclosure of which is hereby incorporated by reference. These Mannich bases are prepared by reacting an alkylphenol having at least 50 carbon atoms, preferably 50 to 200 carbon atoms, with formaldehyde and an alkylene polyamine $HN\text{-}(ANH)_nH$, where A is a saturated divalent alkyl hydrocarbon of 2–6 carbon atoms, and n is 1–10, or the condensation product of said alkylene polyamine with urea or thiourea. If desired, the Mannich base may be reacted with a boron compound, such as a boron halide, boric acid, or an ester of boric acid, to form a particularly useful coordinate boron complex. Particularly useful in the practice of this invention is a dispersant sold as Amoco 9250, which is the borated Mannich condensation product prepared from a high-molecular-weight alkylphenol, formaldehyde, and the condensation product of tetraethylene pentamine and urea.

The lubricating oils of this invention contain an oil of lubricating viscosity and from 2.5 to 50 millimols/kg, preferably from 10 to 30 millimols/kg, of the alkaline earth metal substantially saturated aliphatic sulfonate and from 0.5 to 20 weight percent, preferably 2–10 weight percent, of the high-molecular-weight Mannich base.

Additive concentrates are also included within the scope of this invention. They usually include from about 90 to 10 weight percent of an oil of lubricating viscosity and are normally formulated to have about 10 times the additive concentration that would be used in the finished lubricating oil composition. Usually, this would be 25 to 100 millimols per kilogram of the alkaline earth metal sulfonate and 5 to 80 weight percent of the succinate. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although any oil of lubricating viscosity can be used.

Suitable lubricating oils which can be used to prepare a lubricating oil composition or concentrate are oils of lubricating viscosity derived from petroleum or synthetic sources. The oils can be paraffinic, naphthenic, halo-substituted hydrocarbons, synthetic esters, or combinations thereof. Oils of lubricating viscosity have viscosities in the range from 35 to 50,000 SUS at 100° F., and more usually from about 50 to 10,000 SUS at 100° F.

Other conventional additives which can be used in combinations with the additive combination of this invention include oxidation inhibitors, antifoam agents, viscosity index improvers, pour-point depressants, and the like. These include such compositions as chlorinated wax, benzyl disulfide, sulfurized sperm oils, sulfurized terpene, phosphorus esters such as trihydrocarbon phosphites, metal thiocarbamates such as zinc dioctyldithiocarbamate, metal phosphorus dithioates such as zinc dioctyophosphorodithioate, polyisobutylene having an average molecular weight of 100,000, etc.

The lubricating oil compositions of the invention are useful for lubricating internal combustion engines, automatic transmissions and as industrial oils such as hydraulic oils, heat-transfer oils, torque fluids, etc. The lubricating oils can not only lubricate the engines but, because of their dispersancy properties, help maintain a high degree of cleanliness of the lubricated parts.

EXAMPLES

The following examples are provided to illustrate the invention. It is to be understood that they are provided for the sake of illustration only and not as a limitation on the scope of the invention.

EXAMPLE 1

Preparation of Calcium Polyisobutenyl Sulfonate

To a 10-gallon glass-lined reactor are added 14,430 g of polyisobutylene haviong a number average molecular weight of 330 and an approximate average carbon number of 24, and 20,600 g of 1,2-dichloroethane. To this mixture is slowly added over a period of 1-¼ hour 7650 g chlorosulfonic acid. The reaction mixture is cooled continuously during the chlorosulfonic acid addition to maintain the temperature at 60° F. After the addition is completed, the reaction mixture is heated to 140° F. After maintaining the temperature of the reaction mixture at 140° F. for 5-½ hours, there is added slowly over a period of 1 hour a solution of 3200 g NaOH in 6400 ml methanol. The reaction mixture is then stripped to 196° F. at atmospheric pressure, and 1 gallon of hydrocarbon thinner and 130 g NaOH in 260 ml methanol are added and the stripping operation continued to 248° F. at atmospheric pressure. The contents of the reactor are cooled and transferred to a larger reactor and sec.butyl alchol and a solution of 6300 g $CaCl_2$ in 32 liters of water is then added. The mixture is stirred at 100°–120° F. for 45 minutes. After settling, the water layer is drained off and the metathesis repeated twice with 3900 g $CaCl_2$ in 18 liters of water. The reaction mixture is then washed 3 times with approximately 4 gallons of water. One kg $Ca(OH)_2$ is added after the first water wash. After the water from the last wash is drained off, the supernatant product solution is filtered through diatomaceous earth. 3000 g of diluent oil is added to the filtrate and the mixture is stripped to 280°

F. and 60 mm Hg pressure to yield 17,070 g of calcium sulfonate concentrate containing 1.85% Ca, 4.57% S and 0.30% Cl. Neutral calcium as sulfonate, determined by Hyamine titration, a procedure published in Analytic Chemistry, Vol. 26, September 1954, pp. 1492–1497, authors Ralph House and J. L. Darragh, is 1.81%.

EXAMPLE 2

Preparation of Sodium Polyisobutenyl Sulfonate

To a 10-gallon glass-lined reactor are added 12,000 g of polyisobutylene having a number average molecular weight of 950 and an approximate average carbon number of 68, and 6000 g of 1,2-dichloroethane. To this mixture is added slowly over a period of 1-½ hours a solution of 2100 g chlorosulfonic acid in 6000 g butyl ether. The reaction mixture is cooled continuously to maintain the temperature at 40° F. After the addition is completed, the reaction mixture is warmed to 104° F. After maintaining the temperature of the reaction mixture at about 100° F. for about 5 hours, there is added slowly over a period of 2 hours 3810 ml of a 25% aqueous sodium hydroxide solution (approximately 1150 g NaOH). 1000 ml of hydrocarbon thinner is added and the reaction mixture is stripped to 195° F. at atmospheric pressure. An additional 10,000 ml of hydrocarbon thinner is then added to yield 32,090 g of product.

EXAMPLE 3

Preparation of Sodium Polyisobutenyl Sulfonate

The procedure of Example 2 is repeated with the exception that the reaction mixture is neutralized with a methanolic solution of sodium hydroxide prepared from 1020 g NaOH and 4300 ml of methanol. The product is 26,780 g of sodium polyisobutenyl sulfonate solution.

EXAMPLE 4

Preparation of Calcium Polyisobutenyl Sulfonate

To the product solutions of Examples 2 and 3 are added half a volume of hydrocarbon thinner and half a volume of isobutyl alcohol, which are mixed throroughly. This is the feed used in the continuous metathesis process.

The apparatus consists of a metathesis column 100 × 5 cm and a water-wash column 100 × 11.5 cm, both packed with ¼" Penn State packing and maintained at 40° C. with heating tape.

The metathesis column is filled with 20% aqueous $CaCl_2$ solution. $CaCl_2$ solution and water are fed into the columns 20 cm from the top at 40 and 80 ml/min, respectively. The outlets are at the very bottom of the columns. The height of the $CaCl_2$ solution and the water level in the columns is controlled by raising or lowering the outlet of 5/16" tubing connected to the bottom outlet of the columns and usually maintained 15 cm from the top.

The product feed solution is pumped into the metathesis column 20 cm from the bottom at 20 ml/min and taken off 2 cm from the top. Residence time of the product in the metathesis column is 20 minutes. The metathesized product is then pumped into the water-wash colunn 20 cm from the bottom at 20 ml/min and taken off 2 cm from the top.

To the water-washed product is then added enough $Ca(OH)_2$ to neutralize any acid product that may have formed and enough diluent oil to give a 70% concentrate after stripping off of the solvent. The stripped and filtered product contains by x-ray fluorescence analysis 1.31% calcium, 1.97% sulfur, 0.07% chlorine and 1.10% neutral calcium as sulfonate by Hyamine titration.

EXAMPLE 5

Preparation of Magnesium Polyisobutenyl Sulfonate

To a 500-ml, 3-necked flask containing 100 ml dibutyl ether is added slowly from a dropping funnel 57 g of chlorosulfonic acid over a period of 5 minutes with ice-water cooling to maintain the temperature below 20° C. A 2-liter, 4-necked flask with nitrogen sparge is charged with 300 g of polyisobutylene having a number average molecular weight of 950 and 150 ml of 1,2-dichloroethane. To this mixture is added from a dropping funnel the chlorosulfonic acid solution over a period of 10 minutes while the temperature increases from 22° to 28° C. The reaction mixture is maintained at 40° C. for 5 hours. Then a solution of 58 g 98% sodium hydroxide pellets in 150 ml water is added dropwise over a period of 10 minutes. During the course of the addition, the temperature is maintained below 25° C. by cooling. To this solution are added 600 ml of hydrocarbon thinner and 50 ml 2-ethyl-1-hexanol. The temperature is increased to 165° C. and maintained for 1 hour. 660 ml of solution is distilled overhead. To the remaining reaction mixtue is added, after cooling, 200 ml hydrocarbon thinner, 300 ml 2-butanol and 400 ml water. The mixture is stirred at 80°–35° C. for ½ hour, transferred to a 4-liter separatory funnel, and the water layer is removed. The supernatant liquid is added to a 2-liter, 4-necked flask and 130 g of magnesium chloride hexahydrate in 400 ml of water is added. The mixture is stirred at 80°–85° C. for 1 hour and then transferred while still hot to a 4-liter separatory funnel. After standing, the aqueous layer is removed and the supernatant liquid is transferred to a 2-liter, 4-necked flask. This procedure is repeated 2 times and then the remaining solution is washed 3 times with 400 ml water. The supernatant liquid is heated to 145° C. bottoms at atmospheric pressure. 375 ml liquid is distilled overhead. The remaining material is cooled and filtered through diatomaceous earth. This filtrate is stripped to 170° C. bottoms at 6 mm Hg. Shortly before the stripping is completed, 130 g diluent oil is added to yield 450 g of magnesium polyisobutenyl sulfonate in oil. The product contains 0.57% neutral magnesium as sulfonate by a Hyamine titration: Mg=0.62% by emission spectroscopy; S=1.88% and Cl=less than or equal to 0.1%, each by x-ray fluorescence analysis.

EXAMPLE 6

To a 500-ml, 3-necked flask containing 100 ml dibutyl ether is added slowly over a period of 21 minutes at 22°–29° C. from a dropping funnel 57 g of chlorosulfonic acid in 50 ml of 1,2-dichloroethane. A 1-liter, 4-necked flask with nitrogen sparge is charged with 200 g polyisobutylene having a number average molecular weight of 950 and 150 ml of 1,2-dichloroethane. To this mixture is added from a dropping funnel the chlorosulfonic acid solution over a period of 18 minutes at a temperature of 22°–27° C. The reaction mixture is maintained at room temperature for 5 hours. The reaction mixture is washed once with a mixture of 250 ml water, 600 ml hydrocarbon thinner and 250 ml isopropyl alcohol, and twice with a mixture of 200 ml water and 200 ml isopropyl alcohol. To the mixture is then added 50 ml concentrated ammonium hydroxide followed by 17 g calcium hydroxide. The temperature is increased to 170° C. and stripped to 165° C. at 5 mm Hg. Shortly before the stripping is complete, 150 g diluent oil is added to yield 474 g calcium polyisobutenyl sulfonate in oil. The product contains 1.0% neutral calcium as sulfonate by Hyamine titration and, by x-ray fluorescence, 1.08% calcium, 1.94% sulfur, and 0.05% Cl.

EXAMPLE 7

To a 2-liter, 4-necked flask under nitrogen sparge is added 750 g of polyisobutylene having a number average molecular weight of 950, 150 ml of 1,2-dichloroethane, and 162 g ethyl chlorosulfonate. The mixture is stirred at 80°–85° C. for 6 hours. Then 300 ml of hydrocarbon thinner is added, followed by the dropwise addition over 15 minutes of a solution of 146 g potassium hydroxide in 300 ml of methanol. During the addition, the temperature increases to 47° C. The mixture is then stripped to 150° C. at atmospheric pressure. The mixture is transferred to a 5-liter, 3-necked flask and 500 ml hydrocarbon thinner, 500 ml 2-butanol, and 700 ml water are added. The mixture is heated to 85° C. The water layer is removed, and then 147 g of calcium chloride dihydrate and 700 ml water is added. The mixture is stirred at 80° C. for ¾-hour and then the water layer is removed. The addition of calcium chloride followed by heating and removal of water is repeated twice, once using 100 g calcium chloride dihydrate in 700 ml water and once using 50 g calcium chloride dihydrate in 700 ml water.

To the mixture is then added 200 ml 2-butanol and the mixture is washed using 700 ml water. It is then stripped to 168° C. at 6 mm Hg. Shortly before the stripping is complete, 340 g diluent oil is added. The product weighs 1136 g, has an alkalinity value of 2.02 and contains 1.03% calcium by Hyamine titration and, by x-ray fluorescence, contains 1.04% calcium, 1.72% sulfur, and less than 0.01% chlorine.

EXAMPLE 8

To a 3-liter, 3-necked flask is added 528 g of polyisobutylene having a number average molecular weight of 339, and 600 ml 1,2-dichloroethane. To this mixture is added dropwise over 1 hour and 40 minutes, 280 g of chlorosulfonic acid. The reaction mixture is maintained at 60°–62° C. for 6 hours under nitrogen sparge. A solution of 100 g sodium hydroxide in 600 ml methanol is added to the reaction mixture over a 30-minute period. The mixture is then heated to 120° C. and 500 ml hydrocarbon thinner is added. After heating to 150° C. and then cooling to room temperature, a solution of 12 g sodium hydroxide in 100 ml methanol is added. This mixture is heated to 150° C. and is held there for 45 minutes. The mixture is then cooled and 250 ml hydrocarbon thinner and 500 ml of 2-butanol is added, followed by a solution of 235 g calcium chloride dihydrate and 700 ml water. The mixture is stirred at 80°–85° C. for 1 hour. One liter hot water is added and the water layer is removed. The resultant emulsion is washed with hot water until substantially no emulsion remains. The mixture is then washed twice with 147 g calcium chloride dihydrate in 700 ml water and 3 times with 700 ml water. The mixture is then stripped to 165° C. at 6 mm Hg and held there for 15 minutes. To the 462 g of product is added 120 g diluent oil. To this mixture is added 350 ml hydrocarbon thinner, 250 ml of 2-butanol, 150 ml water and 25 g of calcium hydroxide. This mixture is stirred at slow reflux for 20 hours. The lower-boiling solvent is then removed by distillation at 150° C., followed by the addition of 350 ml hydrocarbon thinner. The temperature is maintained at 150°–163° C. for 1 hour. The product is then filtered through diatomaceous earth and then is stripped to 167° C. at 6 mm Hg, where it is held for 15 minutes. The product weighs 521 g, has an alkalinity value of 13.7 and contains 2.7% calcium by Hyamine titration and by x-ray fluorescence contains 2.43% calcium, 4.35% sulfur and 0.04% chlorine.

EXAMPLE 9

The compositions of this invention were tested in a Caterpillar 1-G test in which a single-cylinder diesel engine having a 5⅛" bore by 6½" stroke is operated under the following conditions: timing, degrees BTDC 8; brake mean effective pressure, psi 141; brake horsepower 42; Btu's per minute 5850; speed 1800 RPM; air boost, 53" Hg absolute, air temperature in, 255° F.; water temperature out, 190° F.; and sulfur in fuel, 0.4% w. At the end of each 12 hours of operation, sufficient oil is drained from the crankcase to allow addition of 1 quart of new oil. In the test on the lubricating oil compositions of this invention, the 1-G test is run for 60 hours. At the end of the 60-hour period, the engine is dismantled and rated for cleanliness. The ring lands are rated on a scale of 0 to 800, with 0 representing clean and 800 representing black deposits. The ring grooves are rated on a scale of 0 to 100 groove fill, with 0 representing clean. The underhead of the piston is rated on a scale of 0 to 10, with 0 representing dirty and 10 representing clean.

The base oil used in these tests is a mid-continent base stock SAE 30 oil containing 15 mmols/kg of a zinc dihydrocarbyl dithiophosphate, 31 mmols/kg of a calcium phenate, and the amount noted in the table of sulfonate and Amoco 9250, a borated Mannich base prepared from an alkylphenol, tetraethylenepentaamine, urea and formaldehyde.

Test Results - 1-G Caterpillar Test

| Sulfonate, 10-millimols/kg | Grooves | Lands | Underhead |
|---|---|---|---|
| Commercial calcium petroleum sulfonate | 20–2.1–1.8–1.0 | 260–95–45 | 3.0 |
| Product of Example 4 | 42–6.2–0.6–0.5 | 85–25–35 | 3.7 |

What is claimed is:

1. A lubricating oil composition comprising an oil of lubricating viscosity and
   (A) from 2.5 to 50 millimols per kilogram of an alkaline earth metal substantially saturated aliphatic sulfonate wherein the aliphatic group contains from about 50 to 300 carbon atoms, and
   (B) from 0.5 to 20 weight percent of a high-molecular-weight Mannich base or a borated complex thereof.

2. The composition of claim 1 wherein said aliphatic group is a polyolefin-derived group.

3. The composition of claim 2 wherein said Mannich base is a borated Mannich base prepared from an alkylphenol, formaldehyde and the condensation product of tetraethylene pentamine and urea and said aliphatic group is derived from polybutylene, polyisobutylene or polypropylene.

4. The composition of claim 3 comprising from 10 to 30 millimols per kilogram of said sulfonate wherein said alkaline earth metal is calcium or magnesium, said aliphatic group is derived from polyisobutylene of 50 to 100 carbon atoms, and from 2 to 10 weight percent of said Mannich base.

5. A lubricating oil concentrate comprising an oil of lubricating viscosity and (A) from 25 to 100 millimols per kilogram of an alkaline earth metal substantially saturated aliphatic sulfonate wherein said aliphatic group contains about 50 to 300 carbon atoms, and (B) from 5 to 80 weight percent of a high-molecular-weight Mannich base or a borated complex thereof.

6. The concentrate of claim 5 wherein said aliphatic group is derived from a polyolefin group.

7. The concentrate of claim 6 wherein said Mannich base is a borated Mannich base prepared from an alkylphenol, formaldehyde and said aliphatic group is derived from polybutylene, polyisobutylene, or polypropylene.

8. The concentrate of claim 7 wherein said alkaline earth metal is calcium or magnesium, and said aliphatic group is derived from polyisobutylene of 50 to 100 carbon atoms.

* * * * *